US008688533B2

(12) United States Patent
Hite

(10) Patent No.: US 8,688,533 B2
(45) Date of Patent: Apr. 1, 2014

(54) AUCTION METHODS AND SYSTEMS

(76) Inventor: Orin Hite, San Francisco, CA (US)

( * ) Notice: Subject to any disclaimer, the term of this patent is extended or adjusted under 35 U.S.C. 154(b) by 287 days.

(21) Appl. No.: 12/916,170

(22) Filed: Oct. 29, 2010

(65) Prior Publication Data

US 2011/0153449 A1 Jun. 23, 2011

Related U.S. Application Data

(60) Provisional application No. 61/256,214, filed on Oct. 29, 2009.

(51) Int. Cl.
*G06Q 30/00* (2012.01)

(52) U.S. Cl.
USPC ..... 705/26.1

(58) Field of Classification Search
USPC ..... 705/26.1, 37
See application file for complete search history.

(56) References Cited

U.S. PATENT DOCUMENTS

| | | | | |
|---|---|---|---|---|
| 5,826,244 | A | 10/1998 | Huberma | |
| 6,260,024 | B1 | 7/2001 | Shkedy | |
| 6,466,919 | B1 | 10/2002 | Walker et al. | |
| 2003/0041010 | A1 | 2/2003 | Yonao-Cowa | |
| 2003/0225628 | A1 * | 12/2003 | Sandholm et al. | 705/26 |
| 2007/0083437 | A1 * | 4/2007 | Hamor | 705/26 |
| 2008/0133400 | A1 * | 6/2008 | Molloy | 705/37 |
| 2009/0055286 | A1 * | 2/2009 | Levy | 705/26 |

* cited by examiner

*Primary Examiner* — Mila Airapetian
(74) *Attorney, Agent, or Firm* — West & Associates, A PC; Stuart J. West; Shaun N. Sluman

(57) ABSTRACT

A novel online auction system in which both sellers and buyers are compelled to bid their "true value". Potential buyers solicit desired items or services and submit sealed bids. A demand curve is created based on buyer bids, and a potential seller can use the curve to create its own sealed bid. A winning seller is determined, however the system uses the bid of the second-lowest bidding seller to establish the ultimate group of winning buyers and sale price. Winning sellers can choose lower prices to capture higher sale quantities. Second or multiple transactions can be implemented from a single bid, if included in the winning set of bids.

18 Claims, 12 Drawing Sheets

218

*PRICING OPTIONS*

| You can sell: | 10 TV's | 11 TV's |
|---|---|---|
| At unit price: | $100.00 | $95.00 |
| For a net profit of: | X | Y |

FIG. 5

PRICE ADJUSTMENT OPTION:
YOU CAN ADJUST THE SALES PRICE TO ANYWHERE BETWEEN $100 & $120.

Would you like to proceed with adjustment?

YES NO

802

AUCTION METHODS AND SYSTEMS

CLAIM OF PRIORITY

The following application claims priority to U.S. Provisional Patent Application No. 61/256,214, filed Oct. 29, 2009, the complete contents of which are hereby incorporated by reference.

BACKGROUND

1. Field of the Invention

The present disclosure relates to auctions systems, particularly online auction processes.

2. Background

Online auctions represent a popular, important, and often efficient way of doing business in modern society. Reduced overhead costs allow online sellers to offer goods at lower prices than traditional retailers. Bids can normally be placed at any time of day, from the comfort of one's own home, and generally speaking there are no geographical constraints. Because of this ease of access, there can also be a large number of bidders and sellers, creating a network effect—a large number of bidders can encourage more sellers, which, in turn, can encourage more bidders, which can encourage more sellers, etc.

However, traditional auction systems have their downfalls. In some systems, some bidders may have a gambling addition-like mentality where they treat an online auction like a game rather than being primarily concerned with obtaining goods or services. This can skew the prices of items in the auction. Many auction formats require a large investment in time and effort to bid and maintain bids. Standard auction formats require buyers to bid against one another despite being in the same system and seeking the same good or service. Many auction systems are seller sided, requiring a seller to list inventory to allow bidding, including group auction models such as reverse Dutch auctions. In other auctions, there can be uneven representation of items offered for sale—photographs can be inadequate or descriptions may fail to include important information. And perhaps the biggest pitfall in traditional online auction systems is non-truthful bidding and ultimate sales prices, the result of strategic bidding over truthful valuation and spending limits.

The traditional Vickrey auction system is well known in the art and comprises a sealed bid procedure wherein bidders submit a single sealed bid, and do not know the amount of any competing bids. The winning bidder is the bidder with the best bid (be it highest or lowest, depending on a forward or reverse auction). The winner's bid however is ignored and the winning price is set by the second best bid, or first place loser. By removing the winner's bid from the final price, this auction model is thought to create an incentive to only bid one's true value in the auction. This is known as a truth-telling mechanism, as all bidders in the auction create only injury to their potential gains by bidding any price other than their privately held value. The resulting prices are equivalent to a live bidding auction, however they reduce the number of actions to reach the final price, and release bidders from having to gather in one place or time to bid. However, the truth-telling aspect of a Vickrey system is one-sided, as truthful assessments of private value are made by buyers only, and lack features to allow for group purchasing by many bidders.

What is needed is an auction system for assessing the optimal sale price of an item based on the blind, sealed, single-bidding by potential buyers (revealing the true value of the item to them personally), and the semi-blind, sealed bidding by sellers (revealing the number of items they are willing to sell and the minimum profit margin they are willing to accept per item). In such an invention, "blind" can mean that the potential buyer has no knowledge of other potential buyers' bids nor the bids of potential sellers; "semi-blind" can mean that the potential sellers have knowledge of buyer bids, but no knowledge of other potential sellers' bids. Because potential buyers can reveal their bids to potential sellers, normal sales and marketing costs to the sellers are greatly reduced, resulting in prices lower than what would be possible in a standard retail environment, and thereby attracting more buyers.

In such a system, buyers could solicit items from sellers, eliminating much customer acquisition and selling costs and labor required in a traditional sale transaction. Moreover, in such a system, buyers can group together while maintaining individuality, and incentives to both buyer and seller reduce "game" mentality among bidders and simplify time investments.

A system that creates individual and different group purchase bids by buyers can also entice additional network effects by making use of different individual demands. While one price will result to a group of buyers with different bids, buyers are left with different remains in value from their true private bid. To maximize network effects a $2^{nd}$ transaction can be placed within this value, examples including a donation to charity of some or all of the price difference, or carbon credit purchases to offset environmental impacts of their purchase. This allows for a single set of buyers to group bid despite different motivations, those seeking cheaper prices through group bidding, and those seeking to transfer purchases to a system that can transfer normal industry costs such as customer acquisition to more noble causes. Buyers can also be divided into sub groups based upon criteria such as geographic region, resulting in a single group having multiple winning sellers and multiple winning buyer groups, all while still requiring only one action per user.

A system that generates individual buyer bids in a group, will result in a demand curve of buyers. Since the seller's bid will be raised to the $2^{nd}$ lowest offer, there is the possibility that some buyers that the winning seller was willing to sell to will be left out. In some cases it may have been optimal for the seller to have a lower price that results in a higher quantity of buyer bids captured. Such a system can allow for winning sellers to lower their bid within a "price window" between their original sealed bid and the $2^{nd}$ best bid, to capture higher quantity if so desired. Any adjustment in price would benefit all parties, as it would only occur if the seller deemed it more optimal than the winning price, and buyers only stand to gain from a lower price (regardless of whether they are doing multiple transactions within their single bid). The resulting lower price is unique to this auction system versus the known auction art, and would not occur in a standard reverse running or reverse Vickrey auction.

BRIEF DESCRIPTION OF THE DRAWINGS

FIG. 5 depicts one embodiment of a pricing option window.

DETAILED DESCRIPTION

Figure 1:
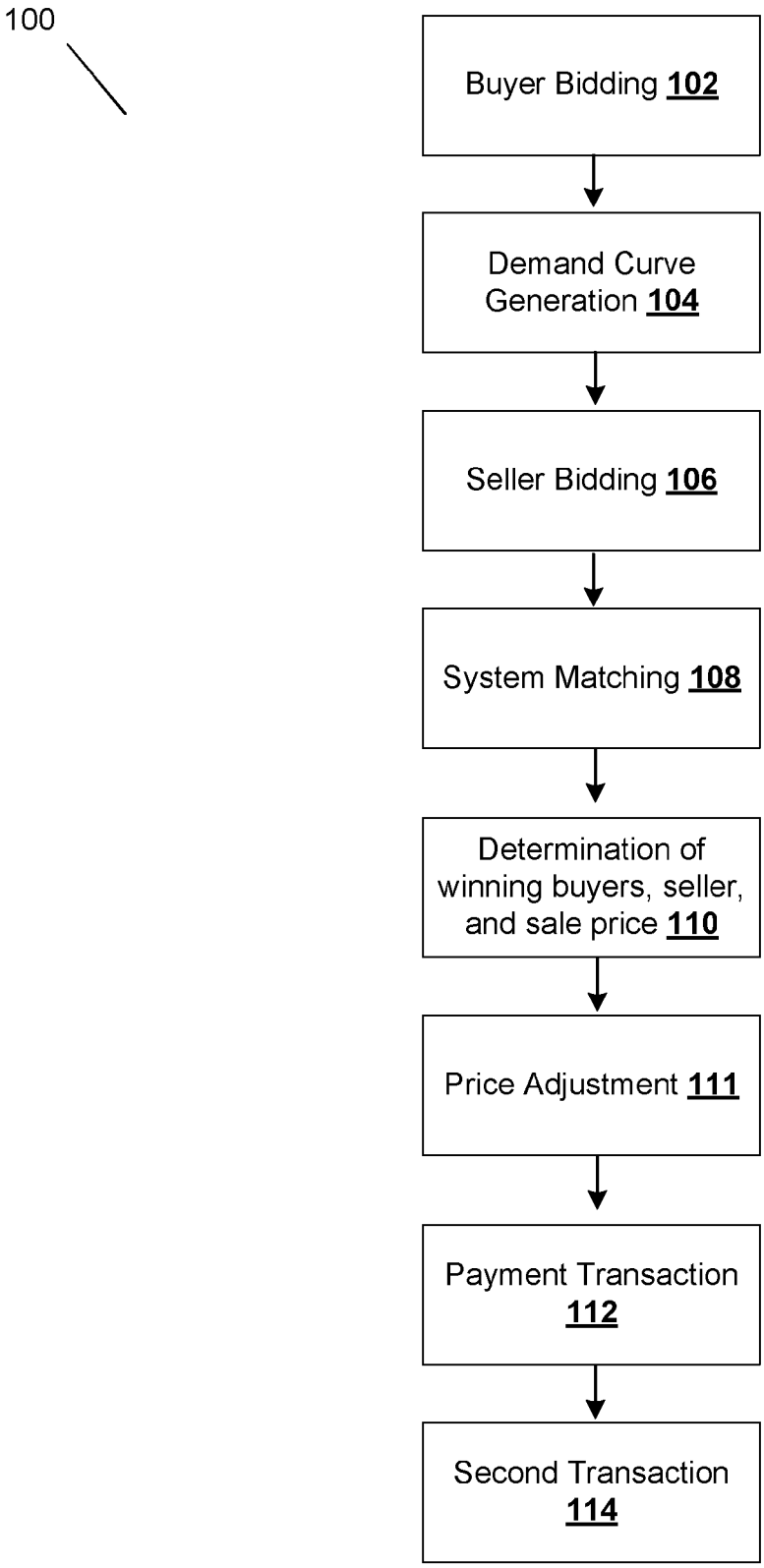
FIG. 1 depicts one embodiment of an auction process 100.
Figure 2:
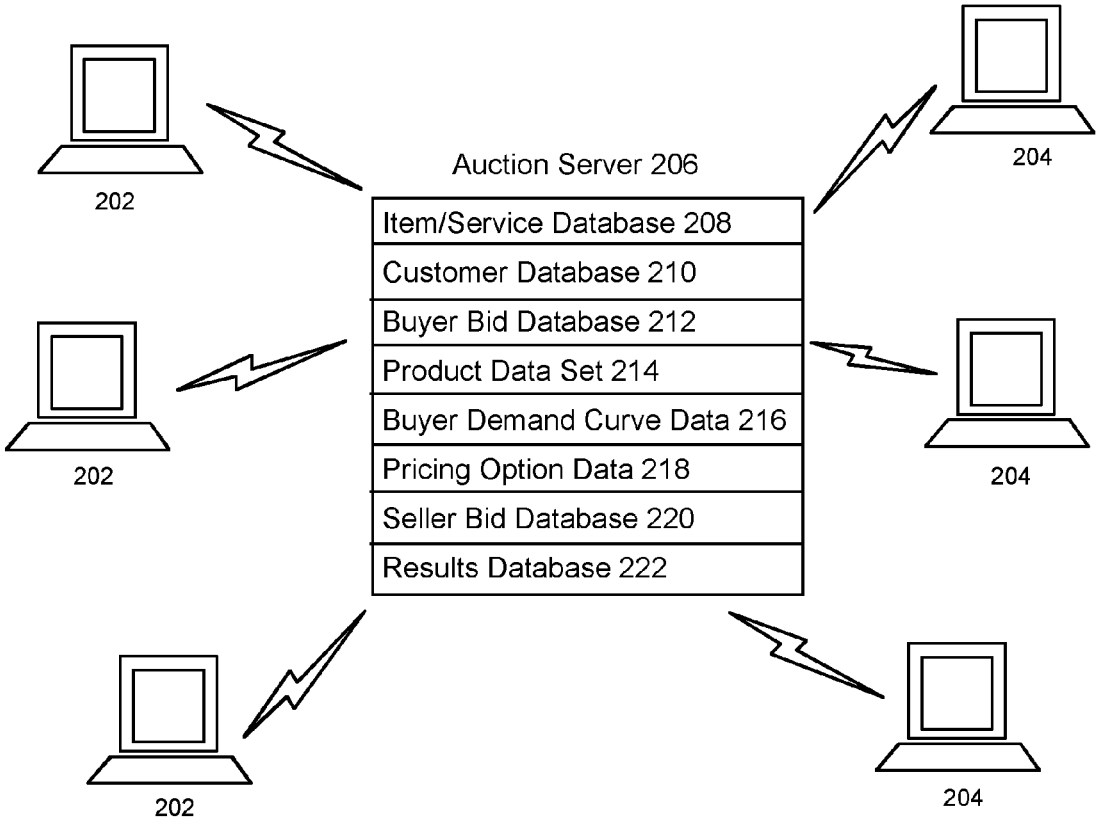
FIG. 2 depicts communication of potential buyers and sellers with an auction server computer 206.

As shown in FIG. 1, an auction process 100 can be comprised of a plurality of the following steps: buyer bidding 102; demand curve generation 104; seller bidding 106; system matching 108; determination of winning buyer(s), seller, and ultimate sale price 110; price adjustment 111, if applicable; completion of payment transaction 112; and secondary or multiple transactions 114, if applicable. As shown in FIG. 2, an auction process 100 can be effectuated by one or more potential buyers 202 and one or more potential sellers 204 communicating with an auction site server computer 206. An auction site server computer 206 can store and process information inputted by potential buyers and sellers 202 204, as well as perform other desired or necessary functions. As appreciated, while a web-based site via a browser will be generally used for explanation purposes, different systems or environments can be used as appropriate to implement various embodiments, such as access via a smart phone application (or "app").

Figure 3:
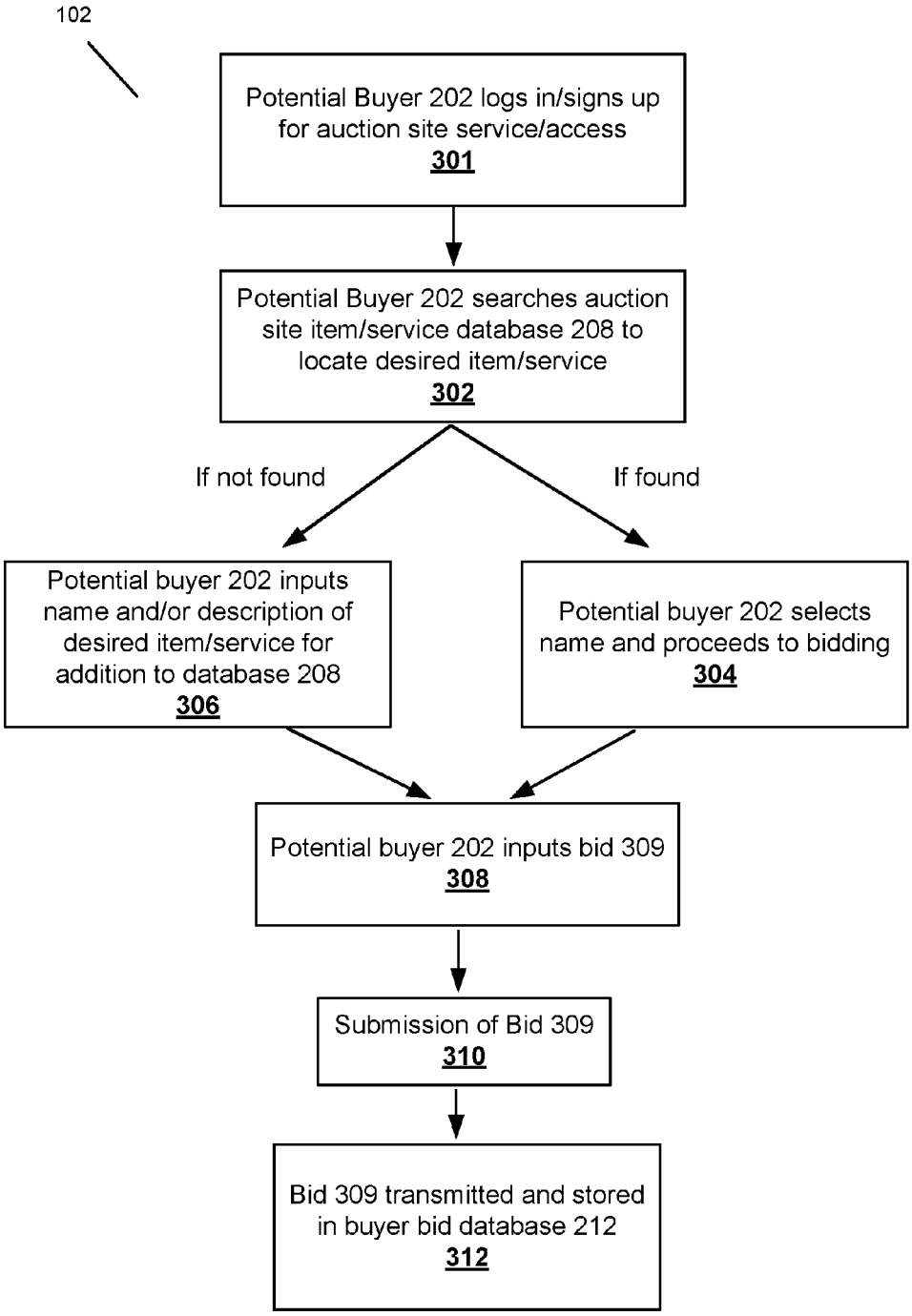
FIG. 3 depicts one embodiment of a buyer bidding process.

A buyer bidding process 102 is depicted in FIG. 3. In step 301, a potential buyer 202 can sign up to use an auction site or, if the potential buyer 202 is already a member of the auction site and personal information is already stored in a customer database 210, can log into the auction site with required login information, such as name and password. In other embodiments, an auction site may not require membership to use the site, and a potential buyer 202 may be able to bid on and purchase an item or service without permanently storing personal information on an auction site server 206.

In step 302, a potential buyer 202 can search or navigate the auction site's item/service database 208 to locate the name of the item or service that the potential buyer 202 wishes to bid on and purchase. If the name of the desired item or service is found in the item/service database 208, a potential buyer 202 can proceed to step 304 and select the item/service name, by clicking on the name or otherwise, and proceed with the next step 308 of the bidding process. If the name of the desired item or service is not found in the item/service database 208, a potential buyer 202 can proceed to step 306 and manually input a name and/or description of the desired item or service, and such name can be added to the item/service database 208 either temporarily or permanently.

Once a desired item or service is identified, in step 308 a potential buyer 202 can input a bid 309. A buyer bid 309 can reflect the truthful value that a potential buyer 202 gives to an item or service. A buyer bid 309 can also reflect the true spending limits that a potential buyer 202 has for a particular auction. In some instances, a buyer bid 309 can also include contact information, credit information, delivery requirements, or any other known and/or convenient piece of information or parameter. This information can be stored along with the bid 309 amount in a buyer bid database 212, as shown in FIG. 2.

In some embodiments, a buyer bid 309 can be sealed, such that other potential buyers 202 are unable to view the amount of a bid 309 or the quantity of other bidders 202. However, in alternate embodiments, while the amount of a bid 309 can remain sealed, potential buyers 202 can view the number of other potential buyers 202 who have made bids 309. Such information can be viewed in real-time as new bids 309 are submitted, or at the close of an auction. In yet other embodiments, some potential buyers 202 may have the option to unseal their bids 309. This embodiment is discussed in further detail below with respect to charity auctions.

An auction 100 can be set up such that a potential buyer's bid 309 can include the total price he or she is willing to pay, including shipping and/or taxes. In the alternative, shipping and sales tax (or any other additional cost) can be disclosed beforehand, but not included in the buyer's bid 309. This can be useful in situations where a seller 204 wishes to provide multiple shipping options to a buyer 202, each with different prices.

The buyer bidding process 102 can be closed upon reaching a predetermined quantity of buyer bids 309. In other embodiments, buyer-bidding 102 can proceed until a predetermined ending time. In step 310, a potential buyer 202 can submit a bid 309. Once a bid 309 is submitted, a potential buyer 202 can be contractually obligated to purchase the item for which they bid, up to the amount of their bid 309, should they be a winner of the auction 100. In step 312, the bid 309 can then be transmitted to an auction site server 206 and stored in a buyer bid database 212 (see FIG. 2).

Figure 4:
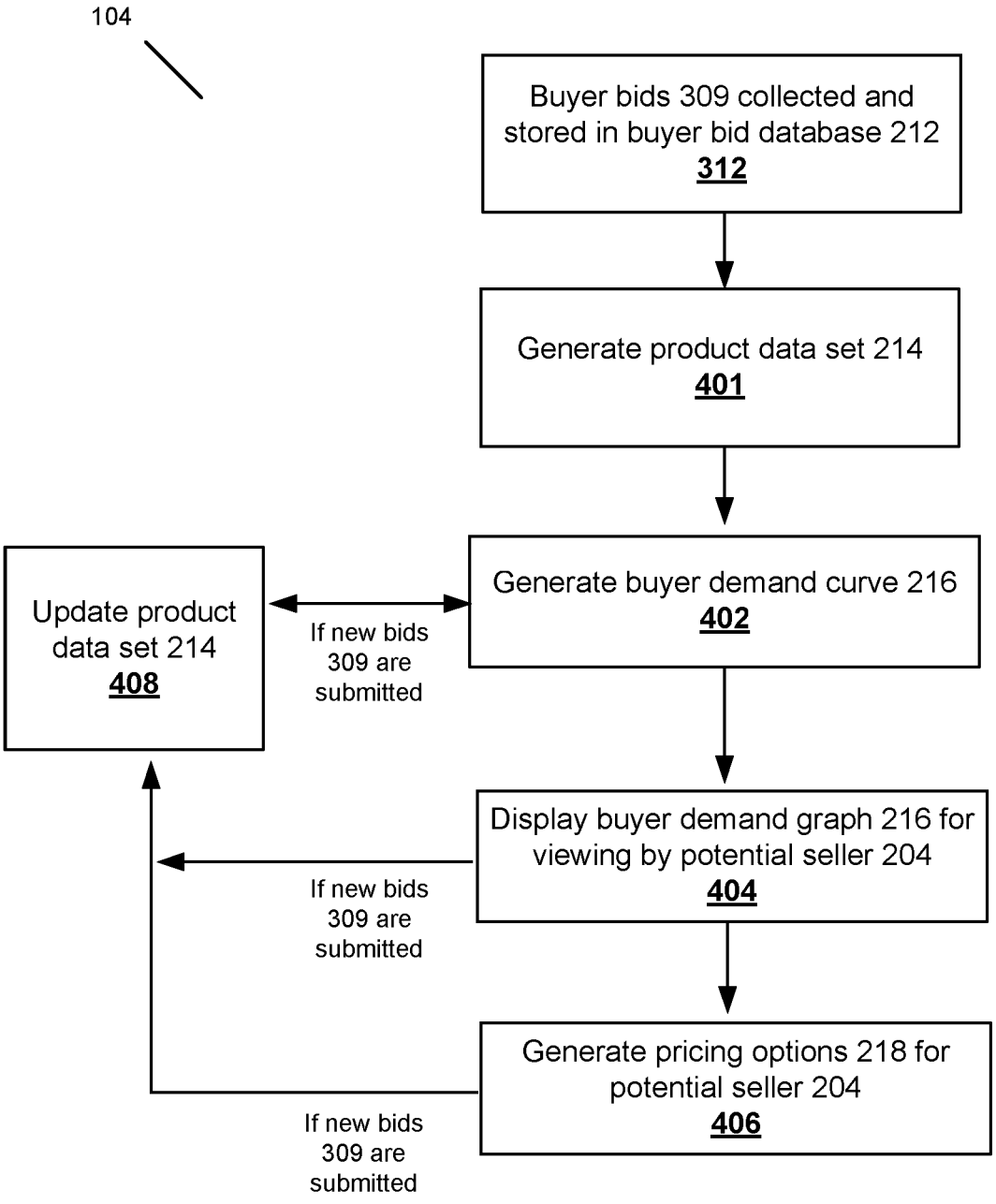
FIG. 4 depicts one embodiment of a buyer demand curve generation process.

One embodiment of a demand curve generation process 104 is depicted in FIG. 4. Continuing from the buyer bidding process 102, where in step 312 buyer bids 309 can be collected and stored in a buyer bid database 212, in step 401 a product data set 214 can be generated from bid data 212. Subsequently, in step 402, a buyer demand curve 216 can be generated. A buyer demand curve 216 can plot the number of bidders against bid 309 price, and can be used by potential sellers 204 when making bids for offers for sale. In step 404, a buyer demand curve 216 can be displayed on a potential seller's 204 computer or other internet-connected device. Additionally, in some embodiments and in step 406, pricing options 218 can be generated and displayed to aid a potential seller 204 in the seller bidding process 106. Moreover, at any point in the demand curve generation process 104, if new buyer bids 309 are submitted, a product set 214 can be updated in step 408. Once a product set 214 is updated in step 408, a new buyer demand curve 216 can be generated, displayed, and, in some embodiments, pricing options 218 can be updated and displayed for a potential seller 204.

Figure 11:
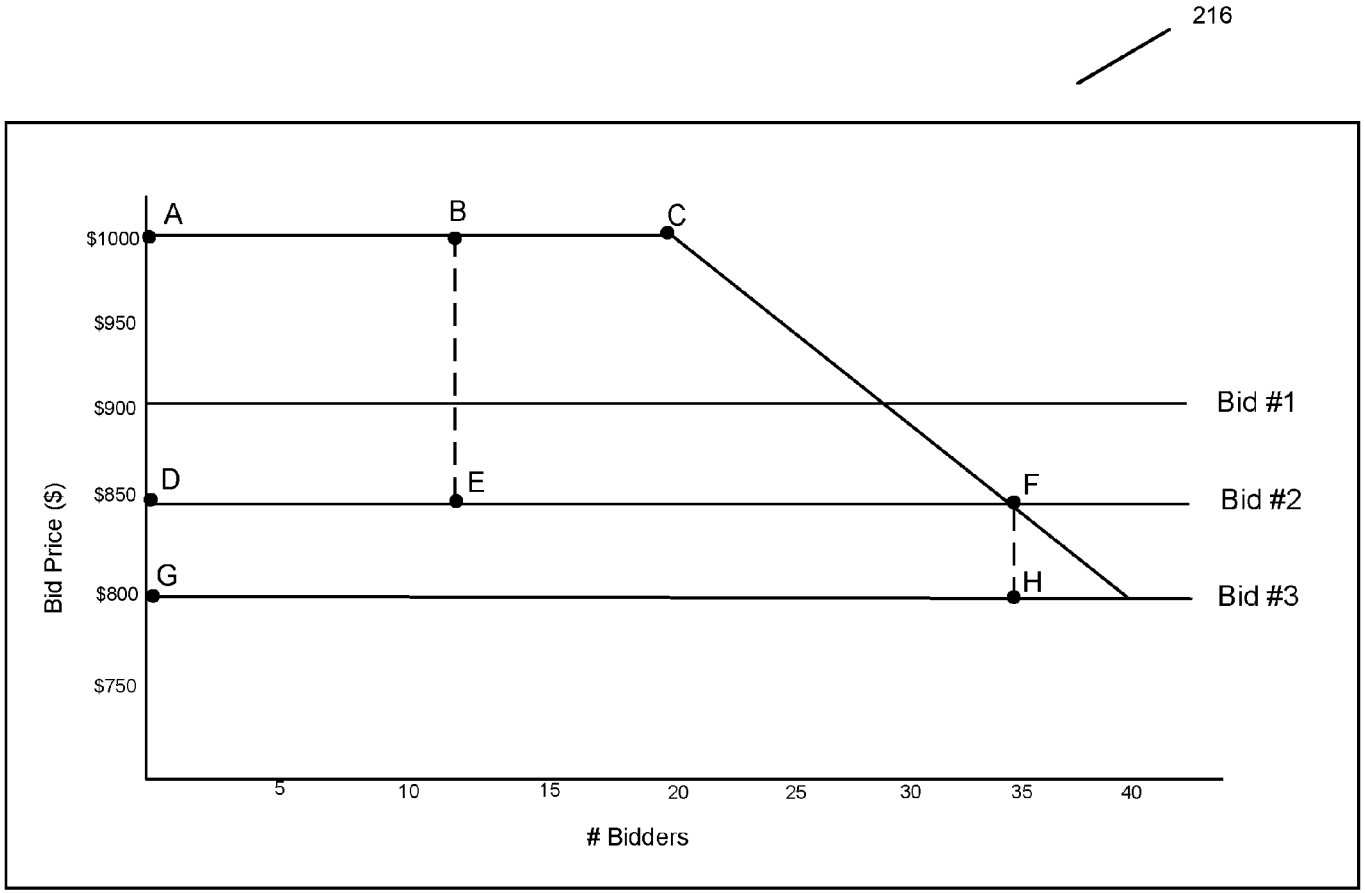
FIG. 11 depicts one embodiment of a buyer demand curve.

An example of a buyer demand curve 216 is depicted in FIG. 11 and described in detail below (see "Economic Analysis" section). A buyer demand curve 216 can be created and/or viewed by a potential seller 204 at any desired and/or logical time in the auction process 100. In one embodiment, a buyer demand curve 216 can be created and viewed by a potential seller 204 as soon as the first buyer bid 309 is submitted and stored on an auction server 206 (i.e., the first point can be plotted on the curve 216 and viewed by a potential seller 204). In other embodiments, a buyer demand curve 216 can be created and/or viewed by a potential seller only after all buyer bids 309 have been collected. In alternate embodiments, a buyer demand curve 216 can be created and/or viewed by a potential seller after some, but not all, buyer bids 309 have been received by an auction server 206, or at any other convenient or desired point in time. In some embodiments, a product data set 214 can be displayed in tabular or any other convenient form in addition to or in lieu of a buyer demand curve 216.

In one embodiment, a potential buyer 202 can select a period of time for which their bid 309 for a given item should remain open. Thus, the product data set 214 from which a buyer demand curve 216 can be created does not contain a specific start and end time, but is an ongoing pool of all non-expired bids. This "living list" expands and contracts as bids 309 expire and new bids 309 are entered. Potential sellers 204 can view this list and make offers for sale.

In an alternate embodiment of the living list embodiment described above, a seller 204 can elect to start an auction 100 by placing an "A" offer and a "B" offer, each with specific time frames for remaining open. The A offer can be implemented as a sealed bid to a specific section of a demand curve 216, with the winning price 701 and winning quantity both determined by the second lowest seller bid 608 (see FIGS. 6-7). If any additional bids 309 are introduced after a seller's 204 A offer has been extended, those bids 309 can be considered after the conclusion of the A offer. If the A offer bid closes without any sale or without enough sales, the B offer can be implemented to help capture more buyers 202.

As previously noted, in some embodiments a buyer's bid 309 can comprise multiple price elements or can be intended to reflect the total amount that a buyer 202 is willing to pay, including taxes, shipping or other elements. In such an embodiment, if non-profit-producing price elements must be taken into account, such as shipping or sales tax for buyers in certain states, a demand curve 216 can be adjusted to reduce buyer bids 309 by those elements, revealing the true price that can be taken into account when a potential seller 202 is calculating potential profit margins.

Pricing option data 218 can be displayed for a potential seller 204 to aid in their determination of an appropriate seller's bid. Once a product data set 214 and/or buyer demand curve 216 is generated, pricing options 218 can be calculated and displayed setting forth the possible profitability for each bid 309 or combination of bids 309. The possible profit can be calculated by multiplying the quantity of the sale item desired by a potential buyer 309 (or group of potential buyers 309) in a data set 214 or demand curve 216, by the profit margin for each bid 309. This method can allow a potential seller 204 to review all of their options and make an informed decision regarding how much to bid during the seller bidding process 106.

For example, referring to FIG. 5, in an auction for the sale of TV's, pricing option data 218 can be displayed showing that, based on bids 309 submitted by potential buyers 202, a seller 204 can sell 10 TV's at $100 each for a net profit of X dollars, or alternatively can sell 11 TV's at $95 each for a net profit of Y dollars.

Moreover, in some embodiments, pricing options 218 can be presented on a buyer demand curve 216 as a plurality of rectangular representations corresponding to potential profit margins for capturing different sets of buyers 202. In such a visualization, the goal is to maximize the area of a rectangle, which is set by quantity sold (length) multiplied by price different between sell price and bid price (height). In some embodiments, a seller 204 can click on or roll over a rectangle to display profit data.

Figure 6:
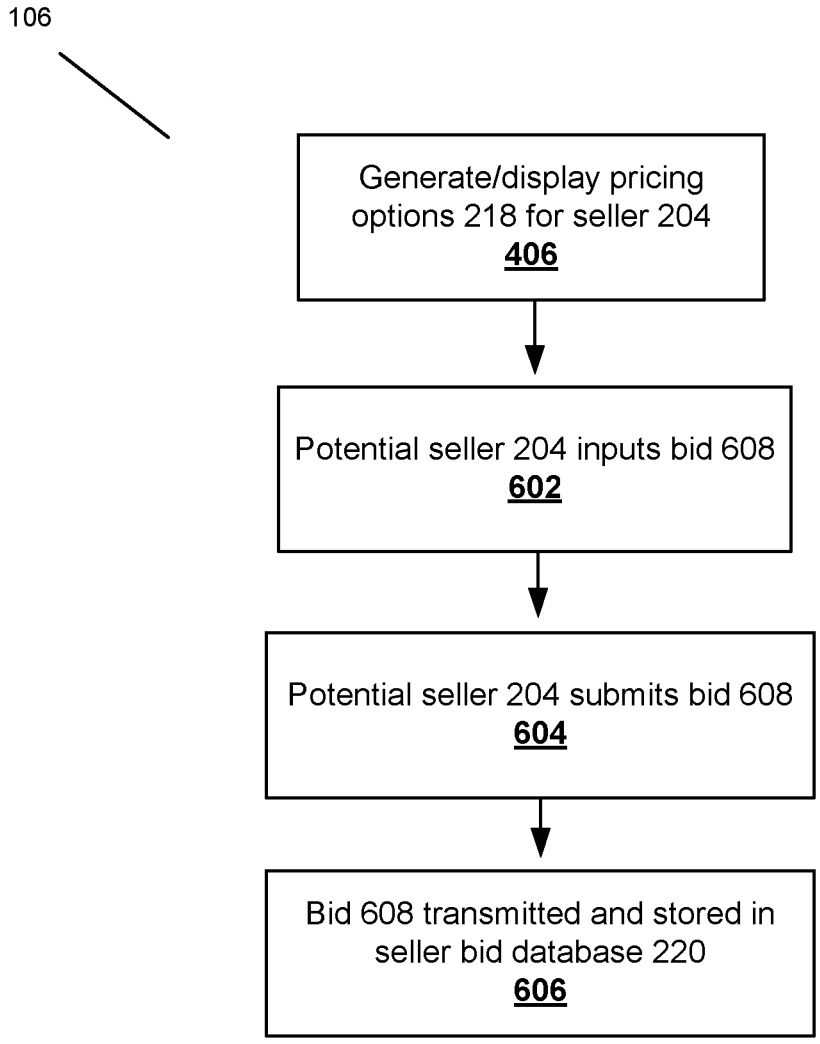
FIG. 6 depicts one embodiment of a seller bidding process.

Using the aforementioned data tools 214, 216, and/or 218, a potential seller 204 can proceed with the seller bidding process 106. Referring to FIG. 6, a potential seller 204 can input a bid 608 in step 602 of the seller bidding process 106. The bid 608 can be submitted in step 604, and transmitted and stored in a seller bid database 220 in step 606.

Figure 7:
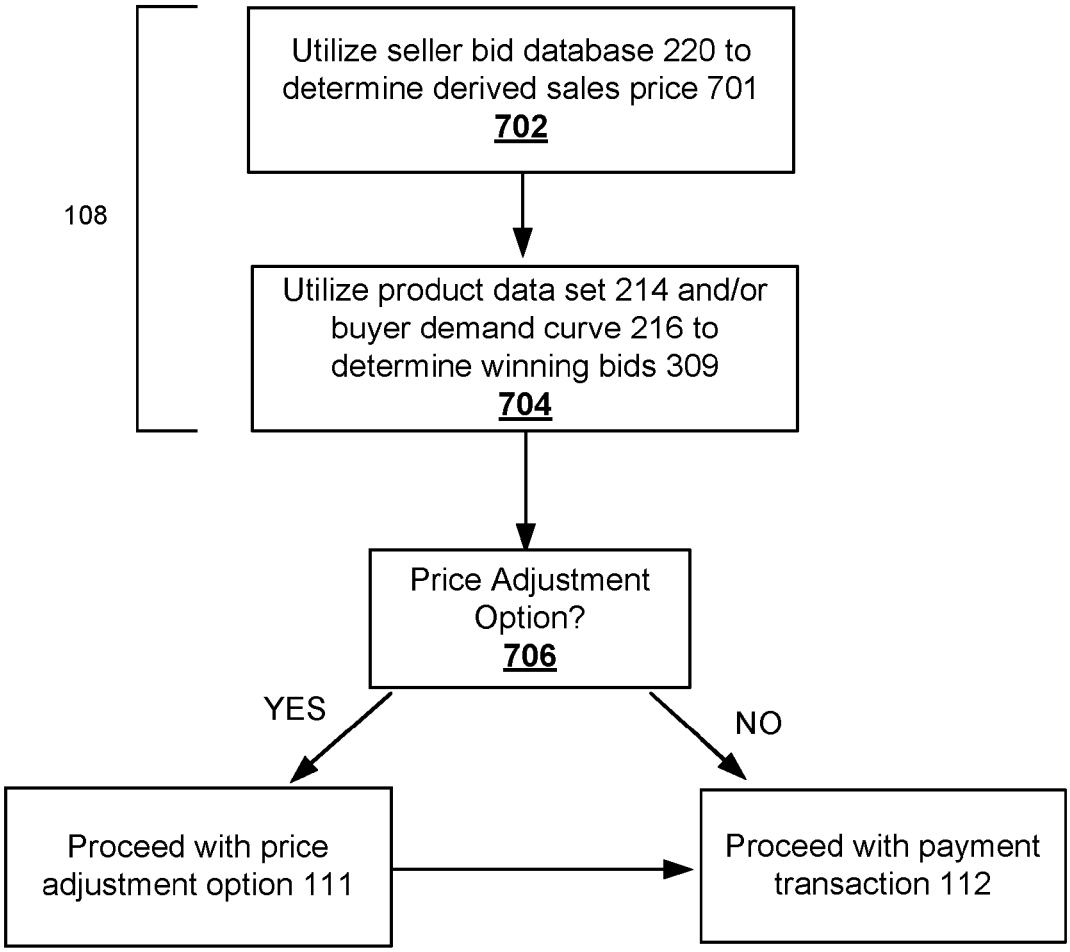
FIG. 7 depicts one embodiment of a system matching process, price adjustment option, and payment transaction.

After seller bidding 106, an auction system 100 can determine a winning seller 204, winning buyers 204, and the final sale price for each item. Referring to FIG. 7, in step 702 of a system matching process 108, a seller bid database 220 can be utilized to determine a derived sales price 701. A derived sales price 701 can be the second-lowest seller bid 608, but the winning seller 204 can be the one with the lowest seller bid 608. Next, in step 704, a product data set 214 and/or buyer demand curve 216 can be utilized to determine winning buyer bids 309. The winning seller 204, derived sales price 701, and winning buyer bids 309 can be stored on an auction server computer 206 in a results database 222.

In situations in which there are more winning buyer bids 309 than a winning seller 204 has supply, the available supply can be allocated via random lottery, which can preserve truthful bidding. In other embodiments, available supply can be allocated to the buyers 202 with the highest bids 309. In an alternate embodiment, available supply can be given to those buyers 202 whose bids 309 have the highest donation or second transaction 114 amount (discussed below). In yet other embodiments, available supply can be dispersed in any other known and/or convenient manner.

Once winning data has been stored in a results database 222, in step 706 the auction system 100 can determine whether a price adjustment option 111 is available to the winning seller 204. If NO, one or more payment transactions 112 can be initiated to compensate the winning seller 204 for the sale of items or services to each winning buyer 202. If YES, a price adjustment step 111 can be commenced.

Figure 8:
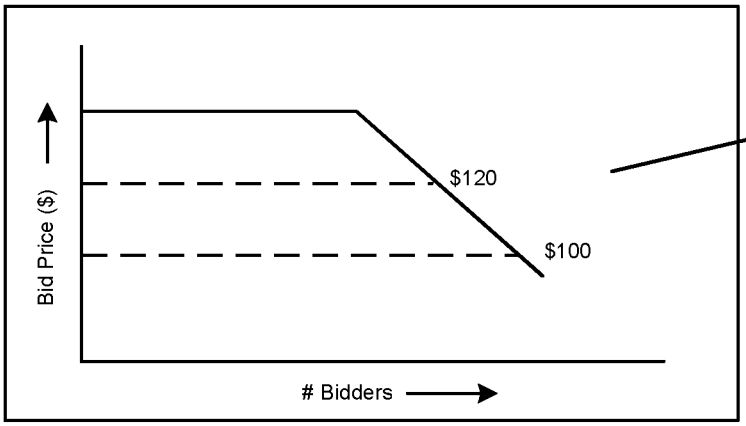
FIG. 8 depicts embodiments of notification and demand curve windows.

In a price adjustment step 111, once a winning seller 204 is chosen, and the second lowest offer for sale 608 is determined to be the selling price 701, the winning seller 204 can be given the option to reduce the price even further in an effort to sell more items (since selling a lot of items at the lower price may be more advantageous to a seller than selling just a few items at a higher price). Referring to FIG. 8, a notification window 801 can notify the winning seller 204 that he has the option to reduce the selling price 701 to any number between the seller's original bid 608 and the second-lowest seller bid 608. In some embodiments, a demand curve window 802 can be displayed such that a winning seller 204 can view the demand curve 216 with the price adjustment option 111 shown graphically. In some embodiments, the auction system 100 can calculate profit margins for the winning seller 204 and an additional display can show the winning seller 204 whether lowering the selling price 701 can maximize his profit. This option 111 can allow for the potential for even lower sale prices than both retail and other known auctions systems such as reverse auctions, since a winning seller 204 can actually see, from the demand curve, whether lowering the price further would be beneficial.

Second or Multiple Additional Transactions

Figure 9:
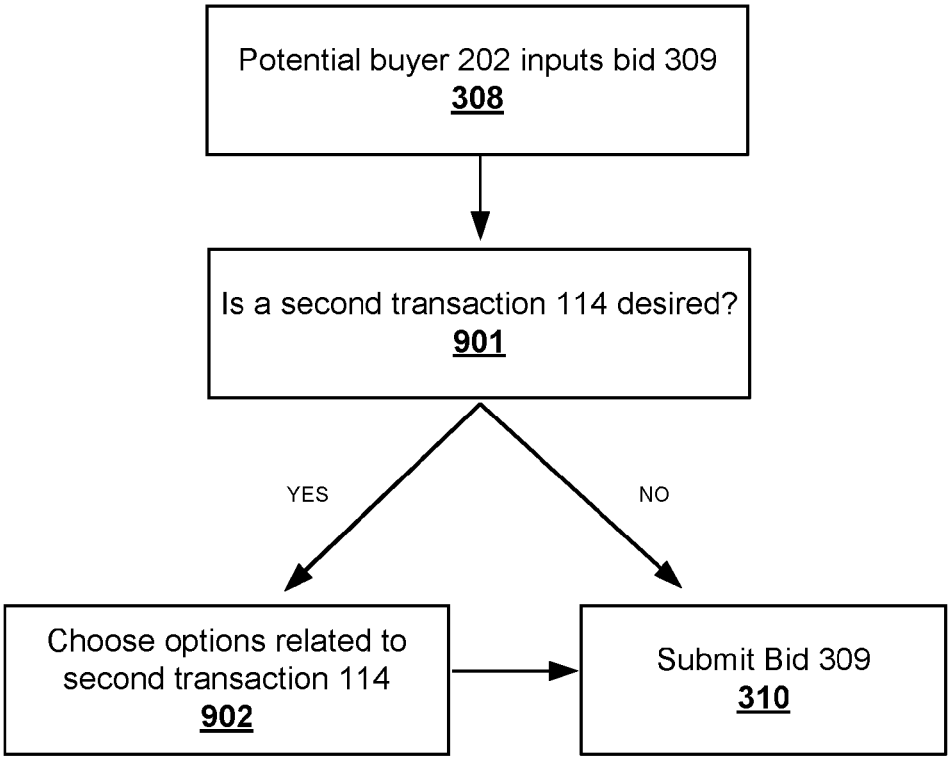
FIG. 9 depicts one embodiment of a portion of a buyer bidding process, including a determination of whether a second transaction is desired.

An auction system 100 can also include the option for a second transaction 114, whereby at the time of bidding, a potential buyer 202 can choose to have any difference between their bid 308 and the final sale price 701 applied to another transaction, should they win. Referring to FIG. 9, after step 308 in the buyer bidding process 102, a potential buyer 202 can proceed to step 901 and determine whether a second transaction 114 is desired. If NO, the potential buyer 202 can simply proceed to step 310 and submit a bid 309. If YES, the potential buyer 202 can proceed to step 902 and choose options for a second transaction 114, should one have the chance to occur, such as type of second transaction 114, amount of difference to be applied to a second transaction 114, or any other known and/or convenient parameter or option. After options are chosen in step 902, a potential buyer 202 can proceed to step 310 and submit a bid 309. In other embodiments, step 901 can happen prior to or concurrent with step 308, or at any other known and/or convenient time in an auction process 100.

In some embodiments, the difference between bid 308 and final sale price 701 can be applied to a bank savings account of the buyer 202, can be converted to a buyer credit on the auction site, or can be applied to pay for more expensive shipping methods such as next day or environmentally friendly shipping, or transferred to any other known and/or convenient account or entity. Multiple additional transactions can be contained within this option and attached to a bid, and this "second" transaction should not be considered limited to a single choice or option.

In one embodiment, a transaction type can be donation to one or more charitable organizations. In some embodiments, a buyer 202 can choose to have only a portion of the difference donated to charity. For example, in one situation a buyer 202 may choose to donate 50% of the difference to charity, while having the remaining 50% transferred to a savings account. In some embodiments, a certain auction 100 can be associated with a particular charity. In other embodiments, a potential buyer 202 can choose from a list of charities. In yet other embodiments, a buyer can chose the charity option, but not pick the actual charity until after the auction has closed (and possibly after the winning buyer 202 has be notified of the amount that will go to charity).

Additionally, in situations where a second transaction option 114 is available to a potential buyer 202, there can also be an option to have a potential buyer's bid 309 made visible to the public or other potential buyers 202 (a potential buyer 202 can choose this option in step 902 of FIG. 9). This embodiment can be implemented for charity auctions or for regular auctions where some bidders choose to donate any excess of a bid 309 to a charity. Having non-sealed bids can make an auction 100 more social, and can provide visibility of bids to encourage more bidding, promote an auction 100, or promote higher bidding in a charity auction. In some embodiments, special recognition could be given to the highest charity bid received in an auction 100, either at the conclusion of the auction 100 or at some point prior to the end of the auction 100.

In some embodiments, an auction process 100 can be performed by buyers and sellers 202 204 visiting an auction website. However, in other embodiments, buyers and/or sellers 202 204 can have the option of using social media such as Facebook or Twitter to submit bids. In yet other embodiments, bidding can be performed via mobile phone text messaging or any other known and/or convenient method. In some embodiments, data can be submitted and/or received by a third-party application or device, such as when a person enables an external phone or web application to display bid activity in real-time, or when a potential buyer or seller 202 204 inputs a bid amount and sends that amount to an auction site server 206.

Geographic Regions

In some embodiments of an auction process 100, potential buyers or sellers 202 204 can choose to define one or more geographic regions with which they would like to do business. For instance, a potential buyer 202 may choose to accept seller bids 608 from local sellers 204 only, in order to allow for quick and easy pick-up from a seller's 204 warehouse. In such an embodiment, multiple buyer groups, multiple sellers, and different final sale prices can result.

Figure 10:
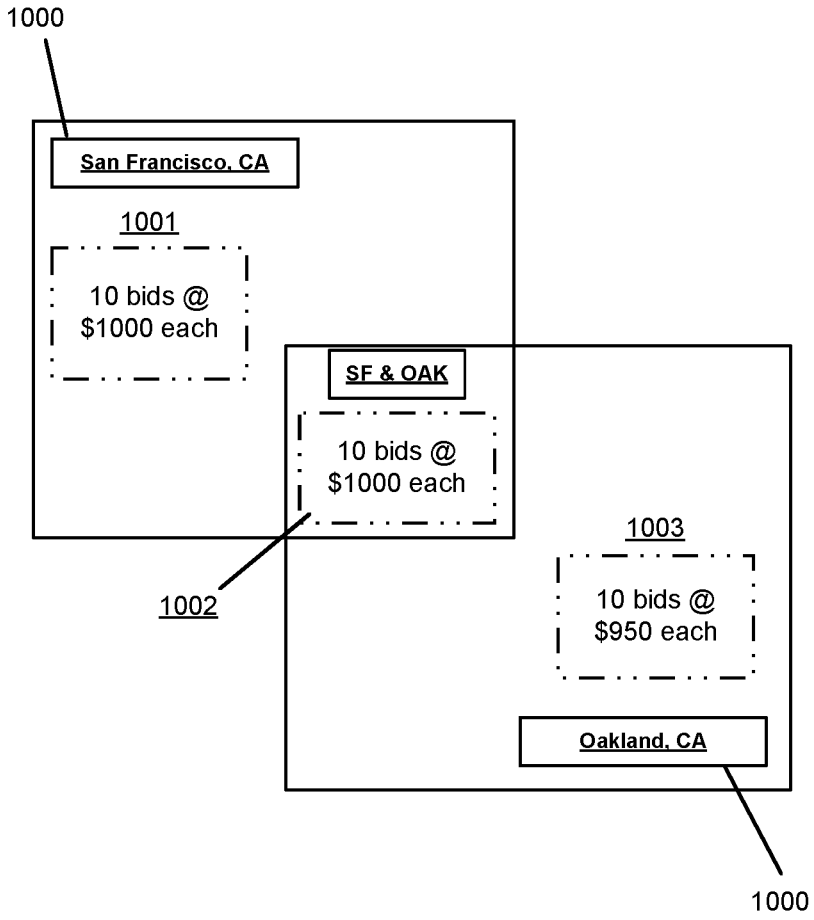
FIG. 10 depicts one embodiment of a plurality of buyer groups that can be formed when a geographic limitation is chosen by potential buyers.

For example, referring to FIG. 10, a particular auction 100 can result in potential buyers 202 wishing to do business with sellers 204 in two geographic regions 1000: San Francisco, Calif. and/or Oakland, Calif. A first group 1001 of buyers 202 chooses to purchase from sellers in San Francisco, Calif. only; there are 10 buyers in the group 1001, and each submits a bid 309 of $1000 for an item. A second group 1002 of buyers 202 chooses to purchase from sellers located in either San Francisco, Calif. or Oakland, Calif.; there are 10 buyers in the group 1002, and each submits a bid 309 of $1000 for an item. Finally, a third group 1003 of buyers 202 chooses to purchase from sellers located in Oakland, Calif. only; there are 10 buyers in the group 1003, and each submits a bid 309 of $950 for an item.

Continuing with the foregoing example, Two sellers ("A" & "B") in San Francisco, Calif. have the inventory for the item desired, and they bid to sell their items at prices of $975 (Seller A) and $925 (Seller B). Two sellers in Oakland, Calif. have the inventory for the item desired, and they bid to sell their items at prices of $950 (Seller C) and $900 (Seller D).

For the 10 buyers offering only to buy from San Francisco, Calif. sellers, this localized auction 100 has only 2 seller bids for them: $975 and $925. As such, Seller B wins this business at $975 (the second lowest seller bid in this localized auction).

For the 10 buyers offering to buy from San Francisco, Calif. or Oakland, Calif. sellers, this localized auction 100 has all 4 seller bids. The two lowest are $900 and $925, so Seller D wins at Seller B's bid price of $925.

For the 10 buyers offering to buy from Oakland, Calif. only, this localized auction has only 2 seller bids for them: $950 and $900. As such, Seller D wins at Seller C's price of $950.

As shown by the foregoing example, by setting geographic regions 1000, some seller bids 608 may or may not apply to various segments of sellers 204. Each seller 204 can see a different buyer demand curve 216 as well (i.e., San Francisco, Calif. sellers see only groups 1001 and 1002 in their demand curves 216; Oakland, Calif. sellers see only groups 1002 and 1003 in their demand curves 216). In this embodiment, a price adjustment option 111 can still be presented to winning sellers 204, in which they can lower a selling price 701 in order to capture unmet demand.

In some embodiments, other requirements of a seller's bid can be used to divide sellers into different groups, in addition to geographic regions mentioned previously. An example is whether a seller is an "authorized seller" of a particular product, which can affect the duration and coverage of a manufacturer warranty. Similar to geographic regions, some bids might not be available to some sellers, if they were not authorized sellers and buyers did not allow for their bid to be available to such a seller. An alternative set of limitations could include limitations regarding what features a product must support, to allow for buyers to bid without specifying a specific product. Additionally, limitations such as region, authorization, or any other known or convenient parameter or limitation can be applied to buyers (i.e., a seller can choose to do business with only the buyers that meet certain criteria). Multiple limitations can be used simultaneously to create any number of different demand curves, winning sellers, and winning prices, without changing the auction system from a single action, single group bid pool system.

Economic Analysis

An auction process 100 is a modification of second price auctions, such as Vickrey and Vickrey-type auctions, and can result in benefits for both sellers and bidders. Bidders are encouraged to use this model for several reasons. Unlike other auction models, such as those seen at auction sites such as eBay, the bidders are not competing with each other for goods. Unlike a Vickrey auction (where the $2^{nd}$ highest bid of a buyer sets the ultimate price) or auction sites like eBay, buyers do not compete against each other and it is the $2^{nd}$ lowest bid of a seller that determines price. This system enables profit maximization by allowing a seller to view buyer demand information prior to divulging supply and desired minimum sale price, as well as allowing a winning seller to adjust sale price to capture a larger number of buyers (at a reduced price—see above discussion on "price adjustments").

In many instances, doing business via the Internet results in reduced information costs. The foregoing auction model 100 is intended to further reduce costs for sellers, by allowing buyers to find each other, prior to purchasing items, in order to buy items with a group.

By that same token, the system is beneficial for buyers, as sellers can be compelled to sell at lower prices than retail or other types of auctions, especially when the demand curve reveals that the total margin is below the winning price (i.e., "Pareto optimal" at a lower price—all parties are better off in this situation). Moreover, if the cost to acquire customers via this method is reduced below the costs to acquire customers using traditional marketing and sales techniques, then cost savings can potentially be passed to buyers—a fact alone that could encourage a buyer to use the system 100.

In one embodiment of an auction system 100, single sealed bids are used. In other auction models, opportunity costs arise when bidders do not reveal private value, but instead bid incrementally and monitor auctions to determine if bids should be raised. Even in proxy bid auctions, where a bidder submits an initial unsealed bid as well as a maximum bid for the system to use to maximize the bidder's chance of winning the auction (while the bidder is not monitoring the auction), not all buyers choose to submit their highest private value. In the current auction system 100, since buyers bid only once, and the final price is set by seller bids, buyers can confidently place only a single and true bid for their private value of a good, and all without needing to monitor the auction. Auction systems with many concurrent auctions for the same or similar good can result in a failure of proxy bidding, as there is an incentive to "move" to another auction as you approach your true bid limit, resulting in the abandonment of opportunity costs sunk into a current auction in the hopes of achieving a lower price in another auction.

Sellers are encouraged to use the system 100 by virtue of price discrimination. Effective price discrimination requires the ability to differentiate between types of buyers, offer different buyers different prices, and prevent buyers willing to pay a higher amount from securing items at a reduced price. Because bidders are contractually obligated to buy an item that meets their price, sellers know that if they choose to bid and win an auction, most or all of the customers give a price via auction that they would not have been able to obtain through traditional purchasing methods. Thus, these customers are potentially ones who could have purchased at standard retail rates. In order to maximize margin, sellers must partake in auctions, and must bid their true lowest price, or face the inferior alternatives of both no revenue and no potential for revenue from these customers, as they will be serviced by another seller in the auction.

Auction systems contain strong network effects, in that the value of the system increases for each user with each additional user. The above-described second transaction option 114, which puts part or all of the difference between a bidder's private value and the winning bid, is intended to create groups of diverse buyers. The network effects of potential groups of bidders using the charity version of the second transaction option 114 (people willing to pay a specific price, but willing to use the second transaction option 114 instead of traditional purchasing, as means for giving to charity), can be combined with bidders bidding because they cannot purchase at a price that is available from stores or sellers, and bidders willing to buy through traditional methods but seeking to ensure the lowest price. These three different groups of potential bidders can be combined to create network effects that create better results for any group individually.

The resulting demand curve created by having these three types of bidders represents a diverse enough overall buyer group that sellers are almost guaranteed a satisfactory choice of buyers. This can encourage sellers to bid and bid truthfully. While this method creates a unique unknown for sellers, an unknown in both price and quantity, that is not present in other methods such as the standard Vickrey auction, the results of all actors acting truthfully and together within this model creates results that are Pareto efficient for all winning participants, both buyer and seller.

An example of an auction process 100 incorporating the second transaction option 114 and having a diverse group of potential buyers 202 is illustrated in FIG. 11 and described below.

Forty (40) potential buyers 202 bid for an item, to be shipped to their respective addresses. Ten (10) potential buyers 202 enter the auction 100 due to the charity component, and bid the common retail price of $1000 for the item, with any price reduction to go to charity. These bidders chose this system 100 not to save money, but because they have an interest in transferring their purchase from traditional means to this method 100, in order to pass along the benefits of market signaling for price discrimination (and sales and marketing costs) to charity.

Ten (10) potential buyers 202 enter the auction 100 to attempt to find a lower price than available through traditional markets. All ten potential buyers bid $1000 for an item, a price that would allow them to purchase through other means, but they prefer to transfer their purchase to this model due to the potential for savings.

Twenty (20) more potential buyers 202 bid incrementally lower than $1000, from $990 down to $800. These potential buyers are using this model 100 because they cannot be included in the standard market, as their private values are beneath the market price of the item being auctioned.

Three (3) sellers, after review of the potential buyers, decide to bid on a selection of potential customers. A first seller submits a bid to create a contract to sell 30 items at $900 per item. A second seller submits a bid to sell 35 items at $850 per item. A third seller submits a bid to sell 40 items at $800 per item.

The third seller wins, since they had the lowest bid, but the final sale price is set at $850, the second lowest bid. The third seller therefore becomes contractually obligated to sell 35 items at $850, to the group of buyers 202 who placed bids of $850 or more.

If all sellers rationally offered their private value, or minimum acceptable margin, as is most efficient in this model, then the third seller will receive a margin identified by the area DFGH in FIG. 11. This area is the margin that would have been lost by not bidding. The bidder could not have made a different bid to secure a higher margin, and this is their optimal result. Should an auction result in a lower price being more optimal to the seller, the "price window" following the auction close would allow for the seller to adjust to this more optimal result, although this example does not show a utilization of this feature.

The 25 potential buyers who bid $850 or higher, without opting in for the second transaction 114, are contractually obligated to purchase an item at $850. If the group of buyers seeking to lower prices acted rationally and in their best interest, their bid offers of $990 through $800 represent their true private value of purchasing the item through this auction method 100. The utility gained by these 25 buyers is area BCEF in FIG. 11. The bidders could not have made a different bid to secure a higher margin, and this is their optimal result.

The 10 potential buyers who bid $1000, and opted for the second transaction 114 using the difference between the final price 701 and their private values, are contractually obligated to purchase an item at $850. They also have entered into a contract to donate $150 to charity. If they are rational actors, they chose the second transaction 114 because they see the value of each excess dollar as higher if donated than kept, and thus their utility gain is a minimum area ABDE in FIG. 11.

Five potential buyers did not receive an item via the auction. If their prices bid reflect their true private value of the item, they could not have increased their utility by submitted any other bid amount, and this is the optimal result of the auction for these five bidders.

Despite the five potential buyers not receiving an item having bids that exceeded the acceptable bid of the winning seller, in order to ensure truth-telling mechanism on both sides of the auction, these bids must be excluded. This truth-telling mechanism is essential to ensuring the best results for all actors within the auction model, and differs from many other auction systems which emphasis second round negotiation or counter offers as part of the bidding system. The end result of this example is a contract between 35 buyers and one seller, with prices and quantity of items set by the second lowest seller bid, for the purchase of 35 items at $850 each. An additional 10 transactions occur, at a price of the difference between the privately held value of the 10 buyers who opted into potential second transactions 114 at the time of bidding, with the proceeds given to the organization picked at the time of bidding.

Figure 12:
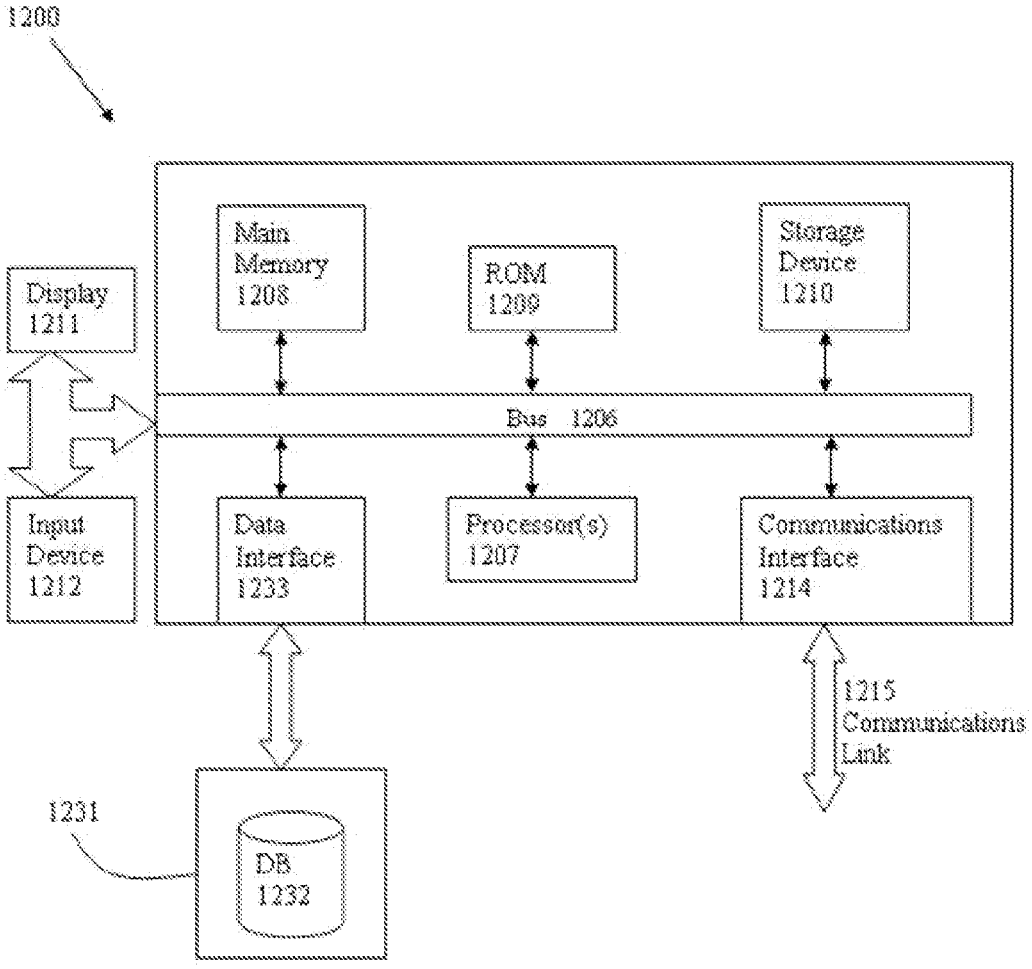
FIG. 12 depicts one embodiment of a hardware implementation of an auction system.

The execution of the sequences of instructions required to practice the aforementioned embodiments may be performed by a computer system 1200 as shown in FIG. 12. In an embodiment, execution of the sequences of instructions is performed by a single computer system 1200. According to other embodiments, two or more computer systems 1200 coupled by a communication link 1215 may perform the sequence of instructions in coordination with one another. Although a description of only one computer system 1200 will be presented below, however, it should be understood that any number of computer systems 1200 may be employed to practice the embodiments.

A computer system 1200 according to an embodiment will now be described with reference to FIG. 12, which is a block diagram of the functional components of a computer system 1200. As used herein, the term computer system 1200 is broadly used to describe any computing device that can store and independently run one or more programs.

Each computer system 1200 may include a communication interface 1214 coupled to the bus 1206. The communication interface 1214 provides two-way communication between computer systems 1200. The communication interface 1214 of a respective computer system 1200 transmits and receives electrical, electromagnetic or optical signals, that include data streams representing various types of signal information, e.g., instructions, messages and data. A communication link 1215 links one computer system 1200 with another computer system 1200. For example, the communication link 1215 may be a LAN, in which case the communication interface 1214 may be a LAN card, or the communication link 1215 may be a PSTN, in which case the communication interface 1214 may be an integrated services digital network (ISDN) card or a modem, or the communication link 1215 may be the Internet, in which case the communication interface 1214 may be a dial-up, cable or wireless modem.

A computer system 1200 may transmit and receive messages, data, and instructions, including program, i.e., application, code, through its respective communication link 1215 and communication interface 1214. Received program code may be executed by the respective processor(s) 1207 as it is received, and/or stored in the storage device 1210, or other associated non-volatile media, for later execution.

In an embodiment, the computer system 1200 operates in conjunction with a data storage system 1231, e.g., a data storage system 1231 that contains a database 1232 that is readily accessible by the computer system 1200. The computer system 1200 communicates with the data storage system 1231 through a data interface 1233. A data interface 1233, which is coupled to the bus 1206, transmits and receives electrical, electromagnetic or optical signals, that include data streams representing various types of signal information, e.g., instructions, messages and data. In embodiments, the functions of the data interface 1233 may be performed by the communication interface 1214.

Computer system 1200 includes a bus 1206 or other communication mechanism for communicating instructions, messages and data, collectively, information, and one or more processors 1207 coupled with the bus 1206 for processing information. Computer system 1200 also includes a main memory 1208, such as a random access memory (RAM) or other dynamic storage device, coupled to the bus 1206 for storing dynamic data and instructions to be executed by the processor(s) 1207. The main memory 1208 also may be used for storing temporary data, i.e., variables, or other intermediate information during execution of instructions by the processor(s) 1207.

The computer system 1200 may further include a read only memory (ROM) 1209 or other static storage device coupled to the bus 1206 for storing static data and instructions for the processor(s) 1207. A storage device 1210, such as a magnetic disk or optical disk, may also be provided and coupled to the bus 1206 for storing data and instructions for the processor(s) 1207.

A computer system 1200 may be coupled via the bus 1206 to a display device 1211, such as, but not limited to, a cathode ray tube (CRT), for displaying information to a user. An input device 1212, e.g., alphanumeric and other keys, is coupled to the bus 1206 for communicating information and command selections to the processor(s) 1207.

According to one embodiment, an individual computer system 1200 performs specific operations by their respective processor(s) 1207 executing one or more sequences of one or more instructions contained in the main memory 1208. Such instructions may be read into the main memory 1208 from another computer-usable medium, such as the ROM 1209 or the storage device 1210. Execution of the sequences of instructions contained in the main memory 1208 causes the processor(s) 1207 to perform the processes described herein. In alternative embodiments, hard-wired circuitry may be used in place of or in combination with software instructions. Thus, embodiments are not limited to any specific combination of hardware circuitry and/or software.

The term "computer-usable medium," as used herein, refers to any medium that provides information or is usable by the processor(s) 1207. Such a medium may take many forms, including, but not limited to, non-volatile, volatile and transmission media. Non-volatile media, i.e., media that can retain information in the absence of power, includes the ROM 1209, CD ROM, magnetic tape, and magnetic discs. Volatile media, i.e., media that can not retain information in the absence of power, includes the main memory 1208. Transmission media includes coaxial cables, copper wire and fiber optics, including the wires that comprise the bus 1206. Transmission media can also take the form of carrier waves; i.e., electromagnetic waves that can be modulated, as in frequency, amplitude or phase, to transmit information signals. Additionally, transmission media can take the form of acoustic or light waves, such as those generated during radio wave and infrared data communications.

In the foregoing specification, the embodiments have been described with reference to specific elements thereof. It will, however, be evident that various modifications and changes may be made thereto without departing from the broader spirit and scope of the embodiments. For example, the reader is to understand that the specific ordering and combination of process actions shown in the process flow diagrams described herein is merely illustrative, and that using different or additional process actions, or a different combination or ordering of process actions can be used to enact the embodiments. The specification and drawings are, accordingly, to be regarded in an illustrative rather than restrictive sense.

It should also be noted that the present invention may be implemented in a variety of computer systems. The various techniques described herein may be implemented in hardware or software, or a combination of both. Preferably, the techniques are implemented in computer programs executing on programmable computers that each include a processor, a storage medium readable by the processor (including volatile and non-volatile memory and/or storage elements), at least one input device, and at least one output device. Program code is applied to data entered using the input device to perform the functions described above and to generate output information. The output information is applied to one or more output devices. Each program is preferably implemented in a high level procedural or object oriented programming language to communicate with a computer system. However, the programs can be implemented in assembly or machine language, if desired. In any case, the language may be a compiled or interpreted language. Each such computer program is preferably stored on a storage medium or device (e.g., ROM or magnetic disk) that is readable by a general or special purpose programmable computer for configuring and operating the computer when the storage medium or device is read by the computer to perform the procedures described above. The system may also be considered to be implemented as a computer-readable storage medium, configured with a computer program, where the storage medium so configured causes a computer to operate in a specific and predefined manner. Further, the storage elements of the exemplary computing applications may be relational or sequential (flat file) type computing databases that are capable of storing data in various combinations and configurations.

Although exemplary embodiments of the invention has been described in detail above, those skilled in the art will readily appreciate that many additional modifications are possible in the exemplary embodiments without materially departing from the novel teachings and advantages of the invention. Accordingly, these and all such modifications are intended to be included within the scope of this invention construed in breadth and scope in accordance with the appended claims.

What is claimed is:

1. An online auction method, the method comprising the steps of:

providing an auction server computer;

effectuating a buyer bidding process;

generating a buyer demand curve;

effectuating a seller bidding process;

performing calculations on said auction server computer to determine a winning seller, final sales price for an item, and at least one winning buyer bid based on said final sales price;

introducing to the winning seller a price adjustment option;

performing calculations on said auction server computer to adjust said final sales price if said winning seller chooses to lower said final sales price; and initiating payment of said final sales price from the at least one winning buyer to said winning seller.

2. The method of claim 1, further comprising at least one additional transaction prior to initiating payment of said final sales price.

3. The method of claim 2, wherein said at least one additional transaction is a donation to charity equal to at least a portion of the difference between said final sales price and a winning buyer's initial bid.

4. The method of claim 1, further comprising presenting pricing option data to a seller prior to said seller bidding process.

5. The method of claim 1, wherein said buyer bidding process comprises the steps of:

entering a potential buyer's information to gain access to an auction website running on said auction server computer;

searching said auction website's item database to locate a desired item or service;

selecting a specific desired item or service;

inputting a buyer bid for said desired item or service;

submitting said buyer bid to said auction website; and storing said buyer bid in the buyer bid database of said auction server computer.

6. The method of claim 5, further comprising the step of performing calculations on said auction server computer to determine whether an additional transaction is desired prior to submitting said buyer bid.

7. The method of claim 5, wherein said buyer bid is sealed and not viewable by other potential buyers or the public.

8. The method of claim 1, wherein the generation of said buyer demand curve comprises the steps of:

collecting at least one buyer bid and storing said at least one buyer bid in a buyer bid database stored on said auction server computer;

generating a product data set based on said at least one buyer bid and buyer information;

generating a buyer demand curve from said product data set;

updating said product data set upon receipt of one or more new buyer bids;

displaying said buyer demand curve for viewing by a potential seller;

updating said buyer demand curve upon receipt of one or more new buyer bids;

generating a set of pricing options for use by said potential seller; and updating said set of pricing options upon receipt of one or more new buyer bids.

9. The method of claim 1, wherein said product data set is modified to remove applicable sales tax or shipping charges from said buyer bids, prior to said generation of said buyer demand curve.

10. The method of claim 1, wherein said seller bidding process comprises the steps of:

viewing said buyer demand curve generated by an auction website running on said auction server computer;

inputting a seller bid based on a potential seller's analysis of said buyer demand curve;

submitting said seller bid to said auction website; and storing said seller bid in the seller bid database of said auction server computer.

11. The method of claim 1, wherein said buyer bidding process further comprises the step of choosing at least one additional buying parameter, other than price, chosen from the group consisting of: geographic location of a seller, credentials of a seller, product specifications, and shipping options.

12. The method of claim 1, wherein performing calculations on said auction server computer to determine said winning seller comprises determining the identity of a particular seller who submitted the lowest bid during said seller bidding process.

13. The method of claim 1, wherein performing calculations on said auction server computer to determine said final sales price for an item comprises identifying the amount of the second lowest bid submitted by a seller during said seller bidding process.

14. The method of claim 1, wherein performing calculations on said auction server computer to determine said at least one winning buyer bid based on said final sales price comprises identifying one or more bids that were submitted by one or more buyers during said buyer bidding process that are equal to or greater than said final sales price.

15. The method of claim 2, wherein said at least one additional transaction is based on at least a portion of the difference between said final sales price and a winning buyer's bid.

16. The method of claim 11, wherein said auction server computer considers bids from sellers that meet the conditions of said at least one additional buying parameter when determining said winning seller, said final sales price for an item, and said at least one winning buyer bid based on said final sales price.

17. The method of claim 16, wherein a different winning seller and different final sales price can be determined for two or more winning buyers depending on the at least one additional buying parameters chosen by each of said winning buyers during said buyer bidding process.

18. The method of claim 1, wherein said seller bidding process further comprises:

choosing at least one additional selling parameter, other than price, chosen from the group consisting of: geographic location of a buyer and credentials of a buyer; and wherein said auction server computer considers bids from buyers that meet the conditions of said at least one additional selling parameter when determining said winning seller, said final sales price for an item, and said at least one winning buyer bid based on said final sales price.

* * * * *